US007341172B2

(12) United States Patent
Moore et al.

(10) Patent No.: US 7,341,172 B2
(45) Date of Patent: Mar. 11, 2008

(54) TOOL-LESS ROTATABLE DEPTH ADJUSTMENT FOR FASTENER-DRIVING TOOL

(75) Inventors: Stephen P. Moore, Carpentersville, IL (US); James L. Kuhnwald, Richmond, IL (US); Ryan W. O'Nell, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 13 days.

(21) Appl. No.: 11/228,375

(22) Filed: Sep. 15, 2005

(65) Prior Publication Data

US 2007/0057006 A1 Mar. 15, 2007

(51) Int. Cl.
*B27F 7/02* (2006.01)

(52) U.S. Cl. ..... 227/8; 227/142

(58) Field of Classification Search ..... 227/8, 227/130, 142

See application file for complete search history.

(56) References Cited

U.S. PATENT DOCUMENTS

| | | | | |
|---|---|---|---|---|
| 5,219,110 | A | 6/1993 | Mukoyama | |
| 5,261,587 | A | 11/1993 | Robinson | |
| 5,385,286 | A | 1/1995 | Johnson, Jr. | |
| 5,564,614 | A | 10/1996 | Yang | |
| 5,579,977 | A * | 12/1996 | Yang | 227/142 |
| 5,685,473 | A | 11/1997 | Shkolnikov et al. | |
| 5,839,638 | A | 11/1998 | Ronn | |
| 6,012,622 | A | 1/2000 | Weinger et al. | |
| 6,024,267 | A * | 2/2000 | Chen | 227/8 |
| 6,170,729 | B1 | 1/2001 | Lin | |
| 6,186,386 | B1 | 2/2001 | Canlas et al. | |
| 6,581,815 | B1 * | 6/2003 | Ho et al. | 227/142 |
| 6,695,192 | B1 | 2/2004 | Kwok | |
| 6,866,177 | B1 * | 3/2005 | Chen | 227/142 |
| 2002/0121540 | A1 | 9/2002 | Taylor et al. | |
| 2005/0189390 | A1 | 9/2005 | Taylor et al. | |

* cited by examiner

*Primary Examiner*—Rinaldi I. Rada
*Assistant Examiner*—Nathaniel Chukwurah
(74) *Attorney, Agent, or Firm*—Greer, Burns & Crain, Ltd.; Lisa M. Soltis; Mark W. Croll

(57) ABSTRACT

An adjustable depth of drive assembly for use with a fastener driving tool includes a workpiece contact element having a contact end and an adjustment end, a rotatable adjustment member configured for being securable to the tool and being displaceable between an adjusting position in which the workpiece contact element is movable relative to the tool and a locked position wherein the adjustment end is non-movable relative to the tool, and at least one locking detent being reciprocally engaged and disengaged from at least one locating hole by manually overcoming a spring bias to displace the rotatable member from said locked position to said adjustment position for securing said adjustment end in a selected locked position relative to said housing without the use of tools.

10 Claims, 5 Drawing Sheets

TOOL-LESS ROTATABLE DEPTH ADJUSTMENT FOR FASTENER-DRIVING TOOL

BACKGROUND OF THE INVENTION

The present invention relates generally to fastener-driving tools used to drive fasteners into workpieces, and specifically to pneumatically powered fastener-driving tools, also referred to as pneumatic tools. More particularly, the present invention relates to improvements in a device or assembly which adjusts the depth of drive of the tool. Other types of fastener driving tools such as combustion, powder activated and/or electrically powered tools are well known in the art, and are also contemplated for use with the present depth of drive adjustment assembly. The use of "fastener driving tools" in this application is considered to encompass all such tools, suitable examples of which are sold under the PASLODE brand manufactured by Illinois Tool Works, Vernon Hills, Ill.

Power fastener-driving tools of the type used to drive nails, staples and other types of fasteners typically include a housing, a power source, a supply of fasteners, a trigger for operating the power mechanism and a workpiece contacting element. The latter component is typically reciprocally slidable relative to the housing and connected to the trigger mechanism in some way, so that the fastener will not be driven unless the tool is pressed against a workpiece. Examples of such a prior fastener-driving tool are disclosed in U.S. Pat. Nos. 4,629,106 and 6,543,664, which are incorporated by reference. Examples of such a prior fastener-driving tool is disclosed in U.S. Pat. Nos. 4,629,106 and 6,543,664, which are incorporated by reference.

One operational characteristic required in fastener driving applications, particularly trim applications, is the ability to predictably control fastener driving depth. For the sake of appearance, some trim applications require fasteners to be countersunk below the surface of the workpiece, others require the fasteners to be sunk flush with the surface of the workpiece, and some may require the fastener to stand off above the surface of the workpiece. Depth adjustment has been achieved in pneumatically powered and combustion powered tools through a tool controlling mechanism, referred to as a drive probe, that is movable in relation to the nosepiece of the tool. Its range of movement defines a range for fastener depth-of-drive. Similar depth of drive adjustment mechanisms are known for use in combustion type framing tools.

A conventional arrangement for depth adjustment involves the use of respective overlapping plates or tongues of a workpiece contact element and a wire form or valve linkage. At least one of the plates is slotted for sliding relative length adjustment. Threaded fasteners such as cap screws are employed to releasably secure the relative position of the plates together. The depth of fastener drive is adjusted by changing the length of the workpiece contact element relative to the wire form. Once the desired depth is achieved, the fasteners are tightened.

It has been found that users of such tools are inconvenienced by the requirement for an Allen wrench, nut driver, screwdriver or comparable tool for loosening the fasteners, then retightening them after length adjustment has been completed. In operation, it has been found that the extreme shock forces generated during fastener driving cause the desired and selected length adjustment to loosen and vary. Thus, the fasteners must be monitored for tightness during tool use.

To address the problem of maintaining adjustment, grooves or checkering have been added to the opposing faces of the overlapping plates to increase adhesion when the fasteners are tightened. However, to maintain the strength of the components in the stressful fastener driving environment, the grooves have not been made sufficiently deep to provide the desired amount of adhesion. Deeper grooves could be achieved without weakening the components by making the plates thicker, but that would add weight to the linkage, which is undesirable.

In other conventional tools, a fluted, threaded barrel is threadably engaged with a threaded end of a wire form workpiece contact element. Rotation of the fluted barrel adjusts the depth of drive. A biased, locking mechanism engages the flute to maintain position. In operation, impact forces have been known to cause unwanted movement of the barrel, changing the depth adjustment.

Other attempts have been made to provide tool-less depth of drive adjustment, but they have also employed the above-described opposing face grooves for additional adhesion, which is still prone to the adhesion problems discussed above.

Another design factor of such depth adjustment or depth of drive (used interchangeably) mechanisms is that the workpiece contact elements are often replaced over the life of the tool. As such, the depth adjustment mechanism preferably accommodates such replacement while retaining compatibility with the wire form, which is not necessarily replaced.

Accordingly, there is a need for a fastener driving tool depth of drive adjustment device or assembly where the adjustment is secured without the use of tools and is maintained during extended periods of fastener driving. There is also a need for a fastener depth adjustment device or assembly which provides for more positive retention of the relative position of the workpiece contact element without reducing component strength.

BRIEF SUMMARY OF THE INVENTION

The above-listed needs are met or exceeded by the present tool-less depth adjustment assembly for a fastener-driving tool which overcomes the limitations of the current technology. Among other things, the present assembly is designed for more securely retaining the workpiece contact element relative to a wire form linkage during tool operation, while at the same time providing adjustability by the user without the use of tools.

More specifically, an adjustable depth of drive assembly for use with a fastener driving tool is provided and includes a workpiece contact element having a contact end and an adjustment end, a rotatable adjustment member configured for being securable to the tool and being displaceable between an adjustment position in which the workpiece contact element is movable relative to the tool, and a locked position where the adjustment end is non-movable relative to the tool. The rotatable adjustment member engages the adjustment end whereby rotation of the rotatable adjustment member causes movement of the workpiece contact element relative to the tool. Further, at least one locking detent is disposed on the rotatable adjustment member and configured for being reciprocally engaged and disengaged from at least one locating hole by manually overcoming a spring bias to displace the rotatable adjustment member from the locked position to the adjustment position. The adjustment position permits the securing of the adjustment end in a selected locked position relative to the housing without the use of tools.

In a preferred embodiment, a locking member is disposed on the tool and has a locating structure disposed thereon. A spring is configured to axially bias the rotatable adjustment member towards the locking member. Disposed on the rotatable adjustment member is at least one locking detent configured to engage the locating structure in the locked position, and to disengage from the locating structure in the adjustment position when the spring bias is overcome.

DETAILED DESCRIPTION OF THE INVENTION

Figure 1:
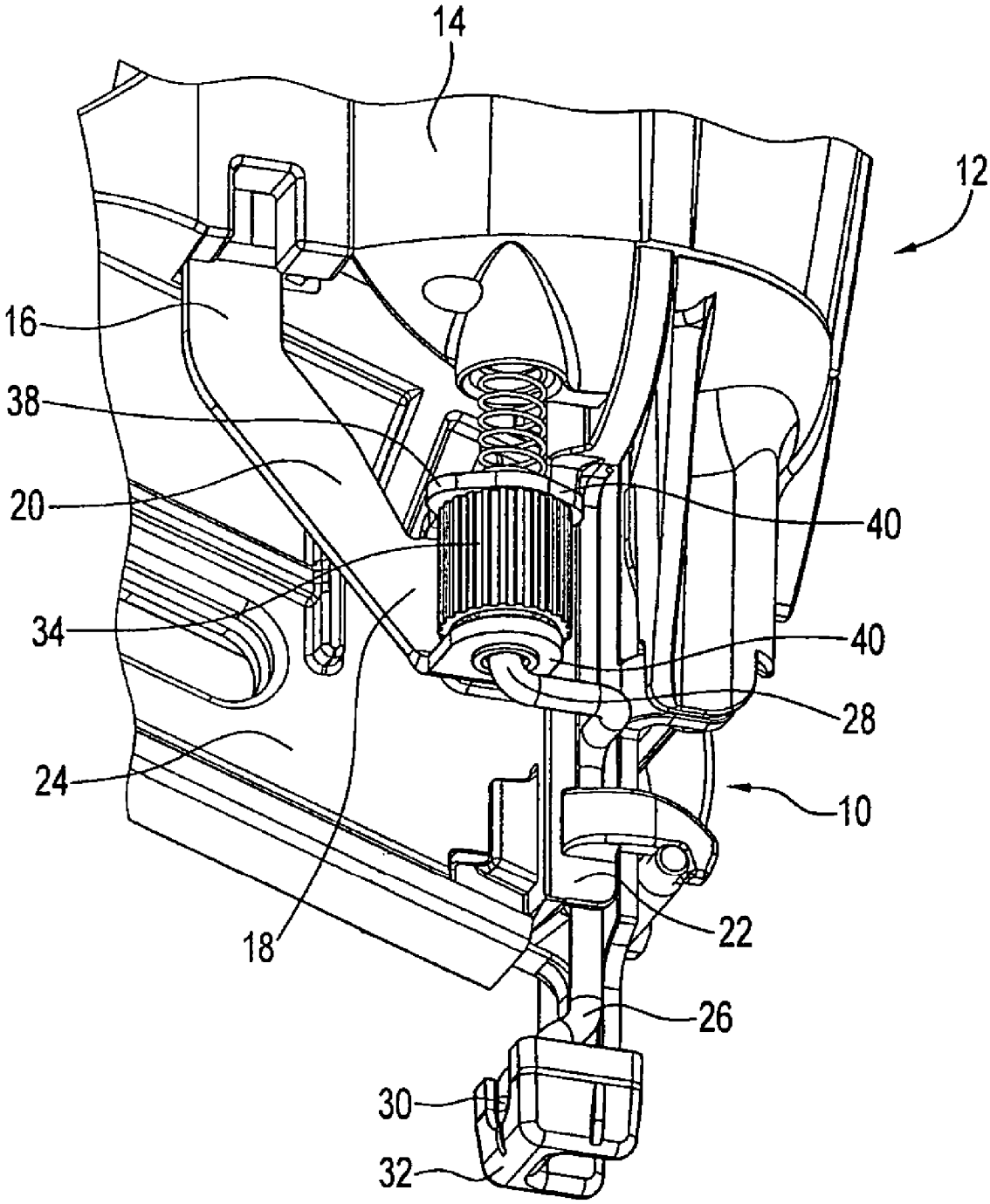
FIG. 1 is a fragmentary perspective view of a fastener driving tool equipped with the present depth adjustment assembly.

Referring now to FIG. 1, an improved adjustable depth of drive assembly is generally designated 10, and is intended for use on a fastener driving tool of the type described above, and generally designated 12. The tool 12 includes a housing 14 enclosing a combustion chamber (not shown) and a reciprocating valve sleeve (not shown) connected to an upper work contact element 16, including a central portion 18 and an elongate arm 20 which is connected at the free end to the valve sleeve as is known in the art. In the preferred embodiment, the upper work contact element 16 and the central portion 18 are fabricated by being stamped and formed in single piece of metal, however other rigid durable materials and fabrication techniques are contemplated.

Extending from the housing 14 is a nosepiece 22 configured for receiving fasteners from a magazine 24, also as is well known in the art. A workpiece contact element 26 is configured for reciprocal sliding movement relative to the nosepiece 22 and, in the preferred embodiment, surrounds the nosepiece on at least three sides. The present depth of drive assembly 10 is configured for adjusting the relative position of the workpiece contact element 26 to the upper work contact element 16, which in turn alters the relative position of the workpiece contact element to the nosepiece 22. Generally speaking, as the nosepiece 22 is brought closer to the workpiece surface, fasteners driven by the tool 12 are driven deeper into the workpiece.

Figure 5:
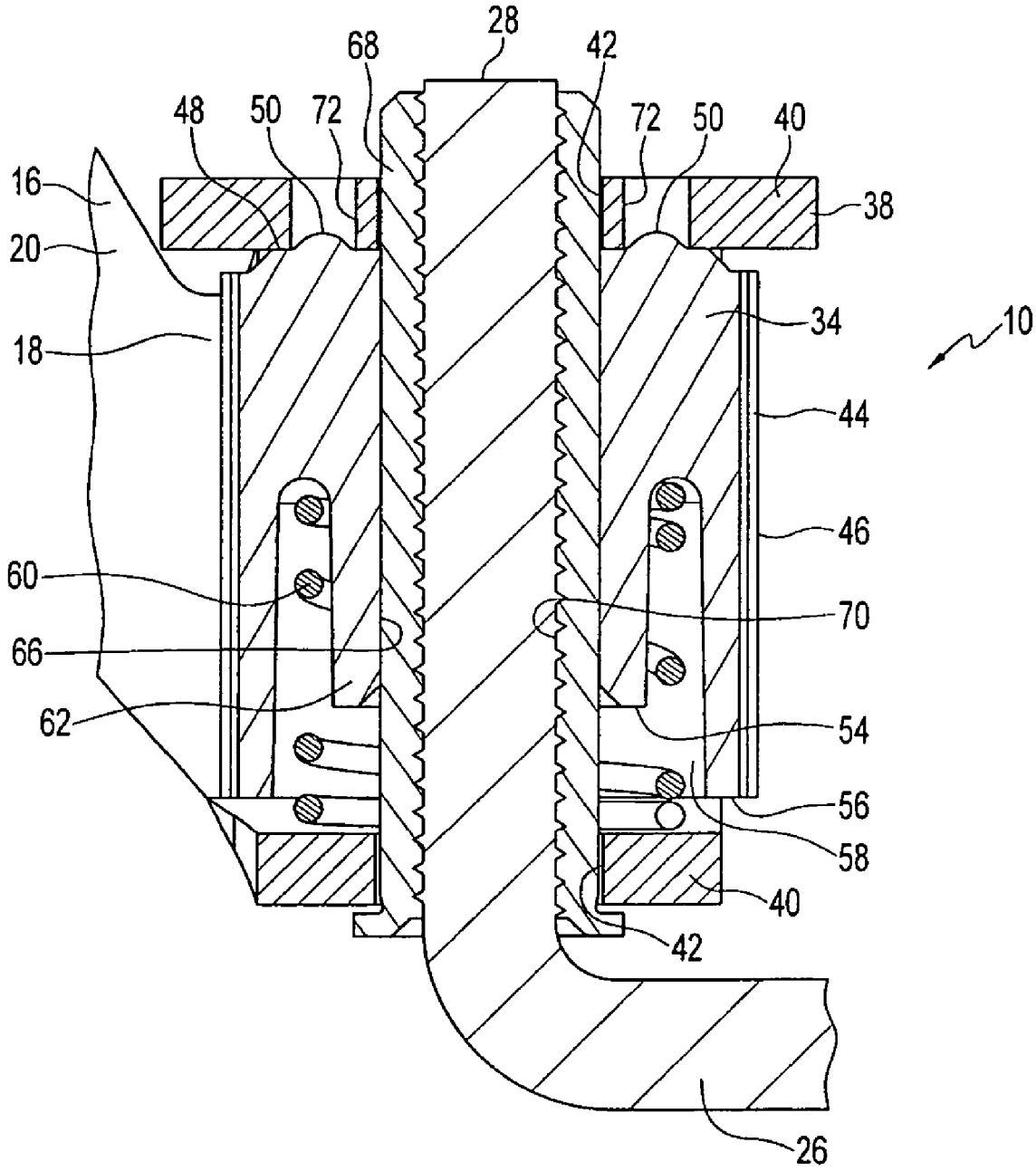
FIG. 5 is a fragmented section view of the depth of drive assembly of FIG. 1 with a workpiece contact element disposed inside a threaded pin.

An adjustment end 28 of the workpiece contact element 26 is preferably threaded (See FIG. 5). Opposite the adjustment end 28, a contact end 30 is configured to contact a workpiece surface into which the fastener is to be driven, as is known in the art. In a preferred embodiment, the contact end 30 has a contact shield 32 disposed over the workpiece contact element 26. The contact shield 32 preferably extends under the contact end 30 and over three sides of the workpiece contact element 26 to contact the workpiece surface.

Figure 2:
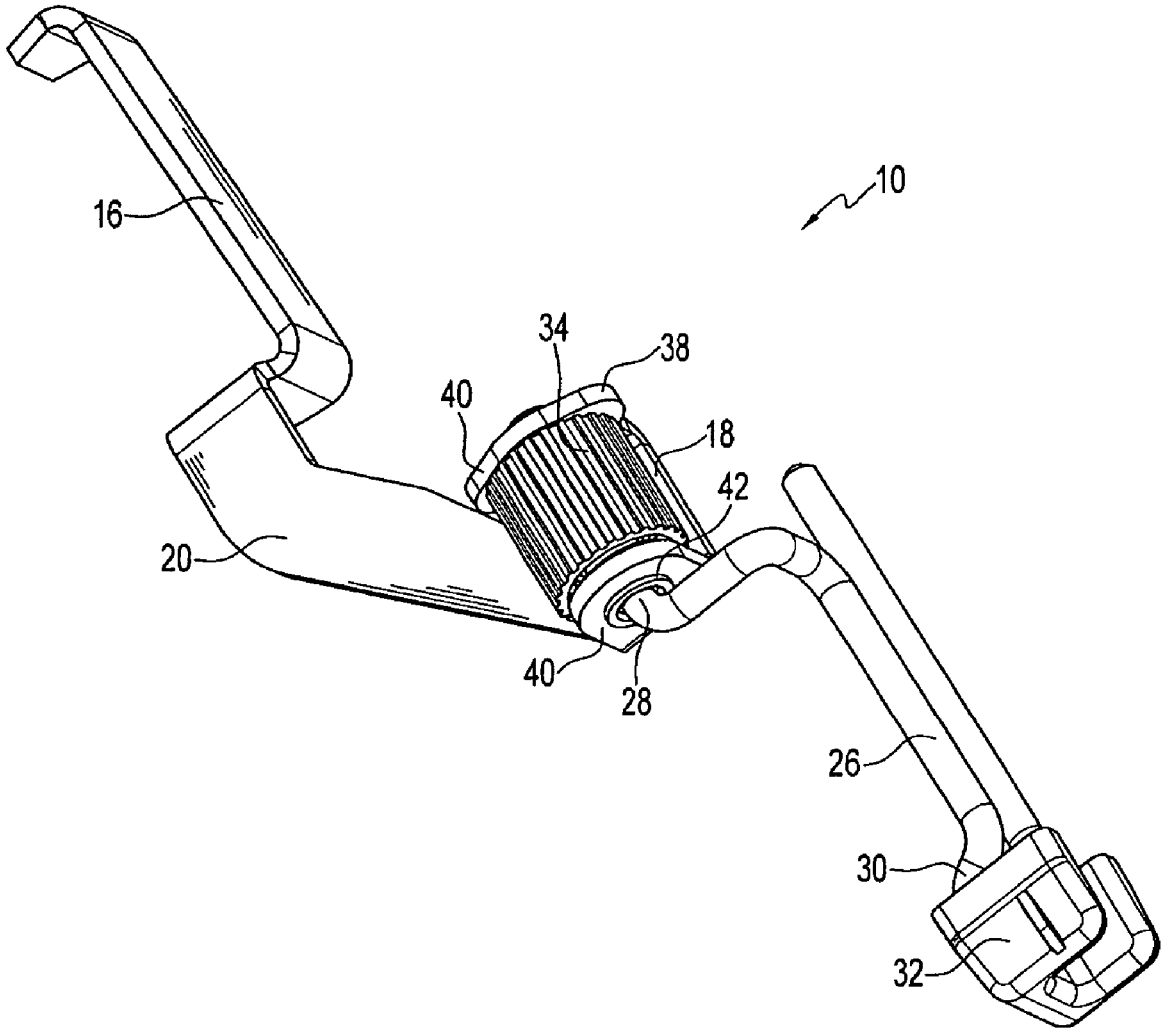
FIG. 2 is a perspective view of the depth of drive assembly of FIG. 1 with a first embodiment of the present locking member.

Referring now to FIGS. 1 and 2, the present depth of drive assembly 10 extends generally coaxially with the nosepiece 22 and the workpiece contact element 26 has a generally elongate "U"-shape. The depth of drive assembly 10 includes a rotatable adjustment member 34 configured for engaging the adjustment end 28 of the workpiece contact element 26 and securing the same relative to the tool 12. Preferably, the central portion 18 is secured to the tool 12 and the rotatable adjustment member 34 is secured to the central portion, as described below. While the central portion 18 is preferably integral with the elongate arm 20, other configurations are contemplated.

A locking member 38 is disposed on the tool, preferably integral with the central portion 18. The locking member 38 preferably includes two opposing legs 40, extending transversely from the central portion 18, and defining a rotating space therebetween. Preferably located on each opposing leg 40 is a throughbore 42 which is generally linearly aligned with the throughbore 42 on the opposite leg (FIG. 5).

Figure 3:
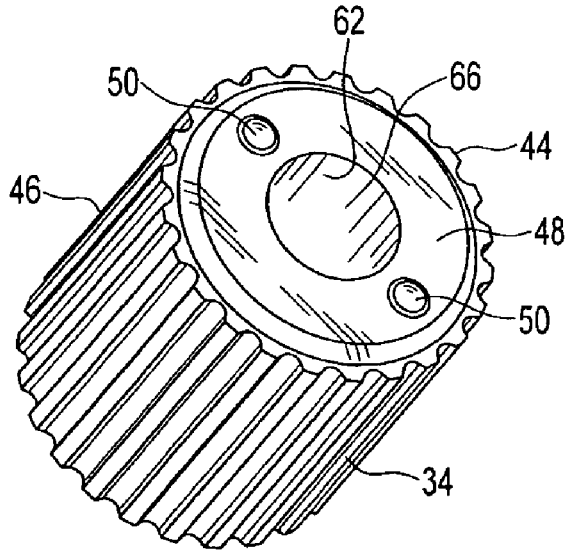
FIG. 3 is a top perspective view of a rotating adjustment member of the depth of drive assembly of FIG. 2.

Referring to FIG. 3, the rotatable adjustment member 34 is generally cylindrical and preferably has a gripping formation 44, such as corrugations or flutes, on a generally circular, exterior surface 46. The gripping formation 44 is the surface where the user contacts the adjustment member 34 to manually rotate the adjustment member with respect to the tool 12.

On a top, exterior surface 48 of the rotatable adjustment member 34, at least one locking detent 50 is preferably disposed. Preferably a raised formation, the locking detent 50 is preferably non-resilient. Further, preferably both the locking detent 50 and the rotatable adjustment member 34 are made of stainless steel. In the preferred embodiment, two locking detents 50 are disposed generally 180-degrees apart, but other numbers and arrangements of locking detents 50 are contemplated. Further, other materials, shapes and sizes of locking detents are contemplated.

Figure 4:
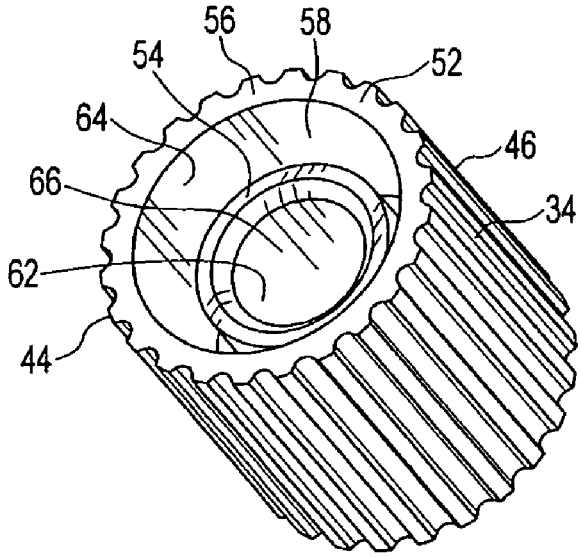
FIG. 4 is a bottom perspective view of the rotating adjustment member of FIG. 3.

Now referring to FIGS. 4 and 5, a bottom, exterior surface 52 of the rotatable adjustment member 34 has an inner diameter portion 54 and an outer diameter portion 56. Disposed between the inner diameter portion 54 and the outer diameter portion 56 is a compression spring pocket 58. A compression spring 60 (See FIG. 5) is inserted into the compression spring pocket 58 to be located between an internal wall 62 and an external wall 64. When the compression spring 60 is not compressed, the spring protrudes from the compression spring pocket 58.

In FIGS. 3-5, the internal wall 62 preferably defines a throughbore 66. When the rotatable adjustment member 34 is disposed between the two opposing legs 40 of the locking member 38, the throughbore 42 of each opposing leg lines up with the throughbore 66 of the rotatable adjustment member. Further, the top, exterior surface 48 of the rotatable adjustment member 34 is biased towards one of the opposing legs 40, while the compression spring 60 pushes against the other of the opposing legs.

As will be explained in further detail below, the rotatable adjustment member 34 is securable to the tool 12 and is movable between the adjustment position, in which the workpiece contact element 26 is movable relative to the tool 12, and the locked position where the adjustment end 28 is secured to the tool. A feature of the present system 10 is that the displacement of the rotatable adjustment member 34, and the associated locking compression spring 60, between the adjusting position and the locking position, is accomplished without the use of tools.

When the rotatable adjustment member 34 is disposed between the opposing ends 40, an internally threaded hollow or tubular pin 68 is inserted up through the internal wall 62. Concentric with the threaded pin 68, the rotatable adjustment member 34 is maintained between the opposing legs 40 by the insertion of the threaded pin 68 through the throughbore 42 of each opposing leg.

The threaded pin 68 is preferably pressure fit with the rotatable adjustment member 34. Preferably constructed of mild carbon steel, the threaded pin 68 is fixed relative to the rotatable adjustment member 34, to rotate with the rotatable adjustment member. While in the preferred embodiment the threaded pin 68 is a separate piece from the rotatable adjustment member 24, a one-piece rotatable adjustment member 34 with a threaded interior is contemplated. The threaded pin 68 preferably extends through each throughbore 66 of the opposing ends 40, however other configurations that permit the rotation of the pin and the adjustment member 34 are contemplated.

Inside the threaded pin 68, a threaded interior surface 70 is configured to receive the adjustment end 28 of the workpiece contact element 26. When the rotatable adjustment member 34 is rotated, and thus the threaded pin 68 is rotated with the adjustment member, the threaded surface 70 acts on the adjustment end of the workpiece contact element 26. Depending on the direction of threads, rotation of the adjustment member 34 in one direction causes the workpiece contact element 26 to displace upwards, while rotation of the adjustment member 34 in the opposite direction causes the workpiece contact element to displace downwards.

On the locking member 38, preferably at the opposing leg 40 adjacent the top surface 48 of the rotatable adjustment member 34, is at least one locating structure 72. Preferably holes punched into the opposing leg 40 having generally the same dimensions as the locking detent 50, the locating structure 72 is configured to positively receive the locking detent.

Figure 6:
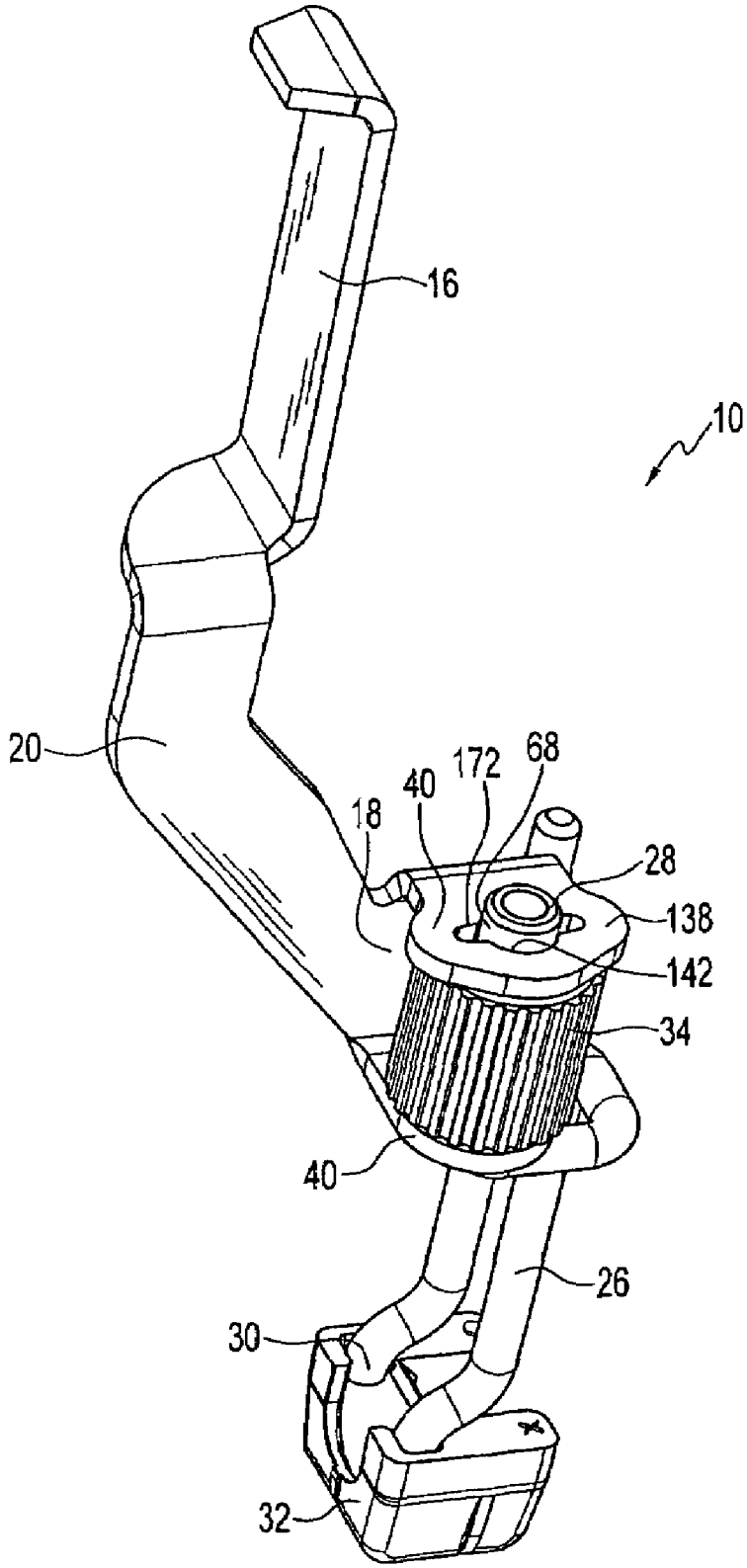
FIG. 6 is a perspective view of the depth of drive assembly of FIG. 1 with an alternate embodiment of the present locking member.

When the locking detents 50 are disposed in the locating structure 68, the rotatable adjustment member 34 is in a locked position, prevented from movement. FIG. 6 shows another embodiment of a locking member 138 having a locating structure 172 where the locating structure and a throughbore 142 are joined as a single hole through the leg 40. Further, FIGS. 1 and 2 show the locking member 38 having a locating structure 72 with a counterbore shape instead of a throughbore shape, however any shape which receives and locks the locking detent 50 is contemplated.

To move the rotatable adjustment member 34 to an adjustment position, the axially directed spring bias must be overcome by axially displacing the adjustment member away from the opposing leg 40. As the rotatable adjustment member 34 is displaced away from the opposing leg 40, the detents 50 disengage from the locating structure 72. When the detents 50 are disengaged, the adjustment member 34 is freely rotatable and, as a result of the rotation, the workpiece contact element 26 displaces up or down in the threaded pin 68.

In the locked position, the workpiece contact element 26 cannot move axially relative to the rotatable adjustment member 34, thus maintaining the desired depth of drive adjustment, even during the stressful environment of repeated actuation (for non-combustion tools) or combustion events, which is known to cause structural stresses on the workpiece contact element 26. It will be seen that the length of the threaded pin 68 and the adjustment end 28 of the workpiece contact element 26 allows the workpiece contact element to be adjusted axially relative to the rotatable adjustment member 34 to achieve a variety of depth adjustment positions to account for a variety of workpiece situations and length of fasteners.

Additionally, it is contemplated that the locked position of the rotatable adjustment member 34 may be manually overridden. Depending on the compression strength of the compression spring 60, the user is able to manually override the locking member 38 by rotating the adjustment member 24 out of engagement with the locating structure 68 without first displacing the member away from the opposing leg 40. In this configuration, the user is able to rotate the adjustment member 24 against the bias of the compression spring 60 until the detent 50 engaged in the locating structure 68. This provides small incremental rotations, or "fine-adjustment," of the depth of drive assembly 10.

While a particular embodiment of the present tool-less depth adjustment for a fastener-driving tool has been described herein, it will be appreciated by those skilled in the art that changes and modifications may be made thereto without departing from the invention in its broader aspects and as set forth in the following claims.

The invention claimed is:

1. An adjustable depth of drive assembly for use with a fastener driving tool, said assembly comprising:

a workpiece contact element having a contact end and an adjustment end;

a rotatable adjustment member configured for being securable to the tool and being displaceable between an adjustment position in which said workpiece contact element is movable relative to the tool, and a locked position wherein said adjustment end is non-movable with respect to the tool, said rotatable adjustment member engaging said adjustment end whereby rotation of said rotatable adjustment member causes movement of the workpiece contact element relative to the tool;

at least one locking detent disposed on said rotatable adjustment member and configured for being reciprocally engaged and disengaged from at least one locating structure on the tool by manually overcoming a spring bias to displace the rotatable adjustment member from said locked position to said adjustment position for securing said adjustment end in a selected locked position relative to said housing without the use of tools, wherein said locking detent is a generally circular raised formation on an exterior surface of said rotatable adjustment member, and wherein said exterior surface is perpendicular to an axis of rotation of said rotatable adjustment member;

said at least one locating structure is generally circular opening on the tool having substantially the same dimensions as said locking detent for receiving said locking detent and preventing the rotation of said rotatable adjustment member with respect to the tool; and an internally threaded pin for engaging said adjustment end of said workpiece contact element, wherein said threaded pin is disposed concentrically within an internal wall of said rotatable adjustment member, and wherein said threaded pin has a longer length than said rotatable adjustment member.

2. The assembly of claim 1 wherein said locking detent can be disengaged from said locating structure by rotating said rotatable adjustment member and manually overriding said spring bias.

3. The assembly of claim 1 further comprising a locking member disposed on the tool and having said at least one locating structure configured to be engaged by said locking detent.

4. The assembly of claim 3 wherein said locking member includes two opposing legs extending transversely from a central portion of the assembly, at least one of said legs having said at least one locating structure and defining a rotating space therebetween for receiving a rotatable adjustment member.

5. The assembly of claim 1 wherein said rotatable adjustment member is generally cylindrical and includes a bottom exterior surface with an inner diameter portion and an outer diameter portion, wherein said inner diameter portion and said outer diameter portion define a compression spring pocket.

6. The assembly of claim 5 wherein a compression spring is disposed in said compression spring pocket to provide said spring bias.

7. The assembly of claim 1 wherein rotation of said adjustment member in one direction causes said workpiece contact element to displace upwards with respect to the tool, and rotation of said adjustment member in the opposite direction causes said workpiece contact element to displace downwards with respect to the tool.

8. The assembly of claim 1 wherein said locking detent comprises a plurality of locking detents located on said rotatable adjustment member in a spaced arrangement.

9. A fastener driving tool, comprising:

a housing;

a work form reciprocating relative to said housing between an extended position and a retracted position;

a workpiece contact element having a contact end and an adjustment end, said workpiece contact element configured for movement relative to said housing between an extended position and a retracted position;

a rotatable adjustment member configured for being securable to said tool and being rotatably displaceable between an adjusting position in which said workpiece contact element is movable relative to said housing, and a locked position wherein said adjustment end is non-movable relative to said housing;

at least one locking detent disposed on an exterior surface of said rotatable member and configured for being reciprocable between a locked position and an adjustment position for securing said adjustment end in a selected locked position relative to said housing without the use of tools; and an internally threaded pin for engaging said adjustment end of said workpiece contact element;

wherein said threaded pin is pressure fit concentrically within an internal wall of said rotatable adjustment member, wherein said internal threads extend within said rotatable adjustment member and extend longer than a length of said rotatable adjustment member.

10. The fastener driving tool of claim 9 wherein said locked position is maintained by an axially directed spring bias, and said locked position can be manually overridden by rotating said rotatable adjustment member and overcoming said spring bias.

* * * * *